United States Patent [19]

Gochanour

[11] Patent Number: 4,784,276

[45] Date of Patent: Nov. 15, 1988

[54] HANGER

[76] Inventor: Gary Gochanour, 3108 Baker Rd., Dexter, Mich. 48130

[21] Appl. No.: 139,608

[22] Filed: Dec. 30, 1987

Related U.S. Application Data

[63] Continuation-in-part of Ser. No. 908,425, Sep. 16, 1986, Pat. No. 4,717,028.

[51] Int. Cl.[4] ..... D06F 53/00

[52] U.S. Cl. ..... 211/89; 211/113; 223/96

[58] Field of Search ..... 211/113, 124, 105.1, 211/89, 133, 13, 66, 168, 116, 194, 60.1, 162, 94; 223/96, 45

[56] References Cited

U.S. PATENT DOCUMENTS

| | | | |
|---|---|---|---|
| 632,077 | 8/1899 | Whitlock | 211/113 |
| 773,017 | 10/1904 | Keuffel | 211/60.1 X |
| 2,036,761 | 4/1936 | Krause | 211/113 |
| 2,210,631 | 8/1940 | Pearl | 211/113 |
| 2,553,710 | 5/1951 | Incampo | 211/113 |
| 2,902,173 | 9/1959 | Staffeld | 223/96 X |
| 2,926,791 | 3/1960 | Hartley | 223/96 X |
| 3,048,312 | 8/1962 | Birnbaum | 223/96 |
| 3,508,664 | 4/1970 | Lessard | 211/89 |
| 3,908,215 | 9/1975 | Watson | 211/11 |
| 4,209,879 | 7/1980 | Paajanen | 223/96 X |

*Primary Examiner*—Ramon S. Britts
*Assistant Examiner*—Sarah A. Lechok Eley
*Attorney, Agent, or Firm*—Flynn, Thiel, Boutell & Tanis

[57] ABSTRACT

A garment hanger comprising spaced, curved divider members, each having a curved garment supporting surface and defining garment receiving spaces, and a pivotable, resiliently biased flap in each space for retaining a garment therein by the weight of the garment.

9 Claims, 4 Drawing Sheets

HANGER

CROSS-REFERENCE TO RELATED APPLICATION

This is a continuation-in-part of Ser. No. 908 425, filed Sept. 16, 1986 now U.S. Pat. No. 4,717,028.

FIELD OF THE INVENTION

This application relates to a hanger, such as a garment hanger, adapted to be firmly mounted on a suitable support, such as a closet rod or a support rod in a clothing store. Particularly, the invention relates to a pant or skirt hanger in which the garment is suspended by its cuffs, its waistband or a fold therein, and is held suspended by means of a pivoting flap.

DISCUSSION OF PRIOR ART

Whitlock, U.S. Pat. No. 632,077, teaches a garment hanger which suspends a garment by means of a pivoting flap to hold a portion of the garment against a base plate by action of the garment's own weight.

Lessard in U.S. Pat. No. 3,508,664 teaches a pants rack using a pants own weight to hold it in place by the pinching action of a center support and a hinged pants holding member.

Hartley, U.S. Pat. No. 2,926,791, teaches a garment hanger in which the hanger is securely fastened to a closet rod.

Birnbaum, U.S. Pat. No. 3,048,312, shows a trousers hanger for supporting a plurality of trousers and constructed of a pair of outer slides with one portion of each slide featuring an opening through which a pair of heavy trousers may be inserted into an associated slot to facilitate hanging.

BRIEF SUMMARY OF THE INVENTION

According to this invention, there is provided a garment hanger adapted to be firmly mounted on a support, such as a closet rod, and especially suitable for hanging pants and/or skirts by their cuffs, waistbands, or a fold therein. The garment hanger comprises at least a pair of spaced-apart curved dividers, at least one of which has a curved garment-supporting surface. A downwardly opening garment-receiving space is defined between the lower ends of the spaced-apart dividers. A pivoting flap extends from a surface of one divider toward the garment-supporting surface of the other divider. The pivoting flap is constructed and disposed so that a garment is inserted into the garment-receiving space by being moved upwardly into the garment-receiving space from below or by being moved laterally inwardly from one lateral side of the garment-receiving space. Then, the garment is released, and the flap engages the garment to hold the garment securely against the garment-supporting surface of the adjacent divider by the garment's own weight. The flap is allowed to pivot through a limited arc so that it does not reach a fully upright vertical position. The pivoting flap may be constructed with a relatively weak leaf-like spring element to provide a weak closing force on the flap sufficient to overcome the friction of the flap's hinge at its base. Usually, a garment hanger comprises a plurality of spaced dividers, so as to be capable of holding a plurality of garments in side-by-side relation.

DETAILED DESCRIPTION OF THE PREFERRED EMBODIMENTS

Figure 1:
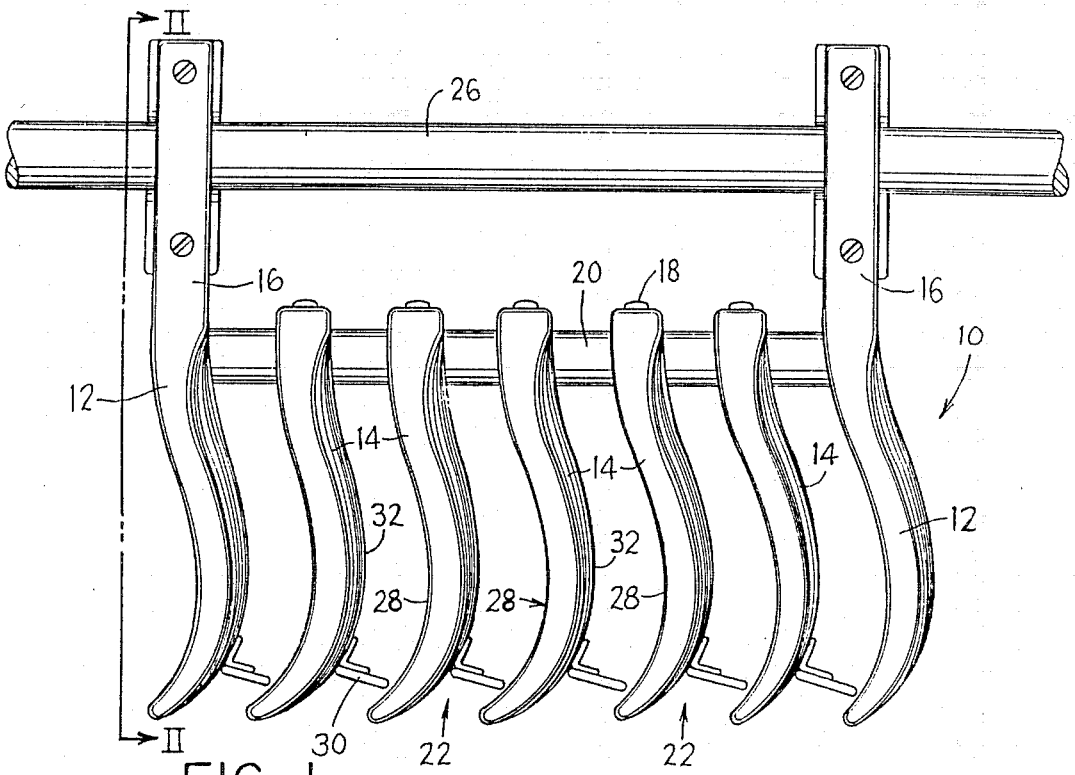
FIG. 1 is a front elevational view of a garment hanger con according to this invention.
Figure 2:
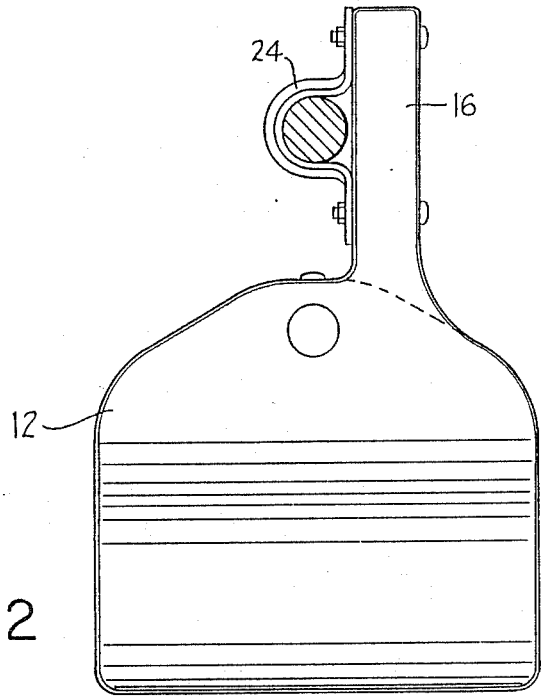
FIG. 2 is a side view of the garment hanger of FIG. 1 take the line II—II.

Looking now at FIGS. 1 and 2 of the drawing, there is illustrated a garment hanger 10 comprising a pair of upright end divider members 12 and a plurality of similarly curved paddle-shaped spaced-apart interior divider members 14, all of which are substantially laterally aligned and parallel with each other. Each end divider member 12, as shown in FIG. 2, has a rod connecting part 16 extending vertically upwardly therefrom to facilitate attachment of the garment hanger to a closet rod, or other support structure. The interior divider members 14, disposed between the end divider members, are each connected by fastening means 18, such as screws, dowels and the like, to a longitudinal member 20 that extends between and is connected in any suitable manner at its ends to the end divider members 12. The longitudinal member 20 provides a rigid support to which the interior dividers 14 are affixed in a stationary spaced-apart relationship. Downwardly opening garment-receiving spaces 22 are defined between immediately adjacent spaced-apart divider members 12 and 14. U-shaped clamping brackets 24 (see especially FIG. 2) fastened, as with bolts, to the connecting parts 16 are provided to firmly secure the hanger 10 to a closet rod 26 thereby preventing the garment hanger from swiveling around or lifting off the closet rod 26 when a garment is inserted into the garment-receiving space between the dividers. Each end divider member 12 and each interior divider member 14 is provided with a curved, somewhat J-shaped, garment-supporting surface 28. The lower ends of the divider members 12 and 14 are curved so that the garment-supporting surface 28 is concave in a direction facing toward one end of the garment hanger, here the leftward end as appearing in FIGS. 1 and 2. The opposite surfaces 32 of the divider members 12 and 14, that is, the rightward surfaces in FIGS. 1 and 2, are convex surfaces which are substantially parallel with the concave surfaces. It is to be noted, however, that the concave and convex surfaces 28 and 32 converge to a narrow tip at the lower end thereof. A garment inserted in the garment-receiving space 22 will contact the adjacent divider at the lower curved portion of the divider's concave garment-supporting surface 28. The outer (leftward) surface of the left-hand end divider member 12 does not function to support a garment, but the member is shaped the same as the right-hand end divider member for economy of manufacture.

Figure 3:
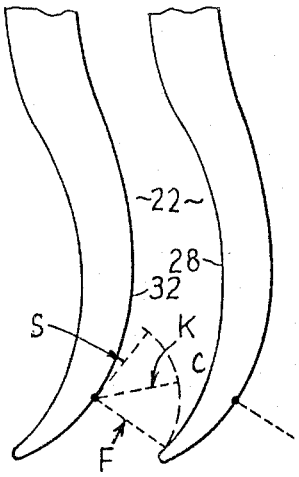
FIG. 3 is a diagrammatic representation of a fragment of the hanger of FIG. 1 showing selected positions of the garment retaining pivoting flap.

An elongated pivotable flap 30 is mounted on the surface 32 of each divider member 12 and 14, except the rightward end divider member 12. Each flap 30 extends across the space between the surface 32 on which it is mounted and the concave garment-supporting surface 28 of the immediately adjacent divider member. The flaps 30 are each pivotally hinged along one longitudinal edge thereof to the surface 32 of their respectively associated divider members. The flap 30 extends transversely toward the garment-supporting surface 28 of the adjacent divider so that its other longitudinal edge 30A (FIG. 6) lightly touches or is just slightly spaced from the garment-supporting surface 28 whereby said flap spans the garment-insertion space 22 between adjacent dividers. In its resting position F (see FIG. 3), owing to gravity, each flap 30 is generally perpendicular to the tangent on the surface 32 from which it extends; when a garment is pushed upwardly into the space 22, the flap 30 is moved to a position S, which does not fully reach the vertical direction. In the garment-holding position, the flap is in an intermediate position K between positions F and S. The ultimate garment-holding position of the flap 30 will depend on the thickness or bulk of the garment.

Figure 4:
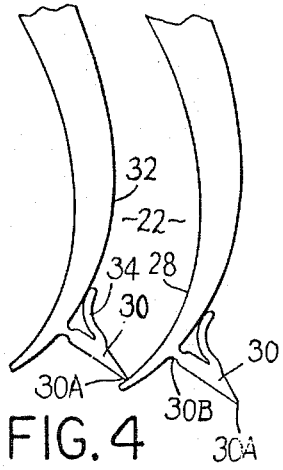
FIGS. 4 and 5 are views similar to FIG. 3 and showing different forms of pivoting flaps according to this invention.
Figure 5:
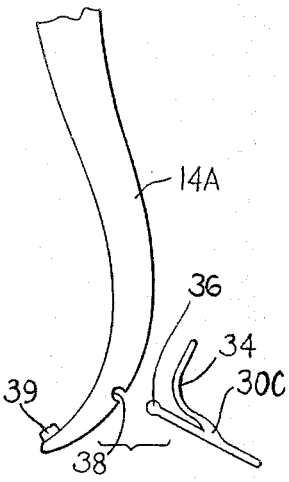

The pivotable flap 30 can be constructed with a weak leaf-like spring portion 34, as shown in FIGS. 4 and 5, which biases the flap 30 for movement to position F for engaging the surface 32. When the flap 30 is pivoted, it cannot be pivoted to a fully upright vertical position. The spring 34 provides a weak closing force on the flap 30 sufficient to overcome the friction of the hinge at the base of the flap. To withdraw a garment from the hanger only requires the pivoting of a flap toward the position S and away from the garment.

The flaps 30, including their weak leaf-like springs 34, when used, can be formed integral with the divider members, as illustrated in FIG. 4, in which a portion 30B of reduced thickness in the flap 30 provides a hinge for the flap. Alternatively, the divider and flap members can be formed separately from one another, as illustrated in FIG. 5. The flap 30C of FIG. 5 is formed with an enlarged hinging end 36 which snaps into a complementary shaped groove 38 in the divider member. The hinge for the flap 30C is provided by the joint, i.e., the enlarged end 36 and the groove 38.

Figure 6:
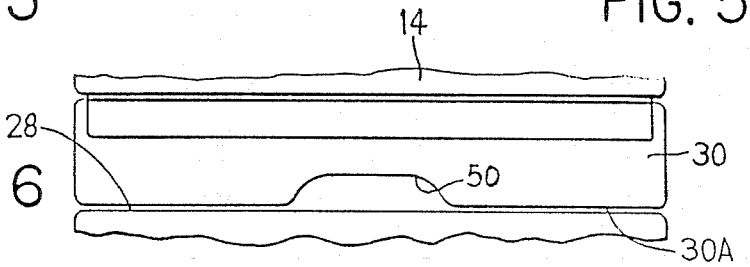
FIG. 6 is a partial top view of a garment retaining pivoting flap.

In all forms of flaps, an indent 50 can be provided on the edge of the flap which contacts the garment, as shown in FIG. 6, to accommodate the seam of the garment, such as a pant seam.

A non-skid strip 39 (FIG. 5) can be provided close to the lower edge of the garment-supporting surface 28 to cooperate with the flap 30 on the adjacent divider whereby to minimize the possibility that the garment will slide off the garment hanger.

Figure 7:
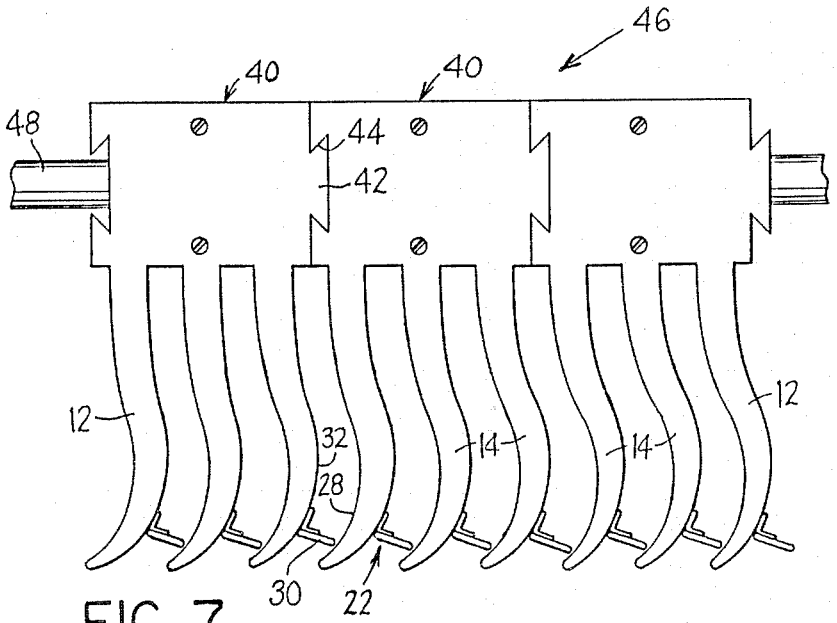
FIG. 7 is a side view of another form of garment hanger constructed according to this invention.

Another embodiment of the garment hanger is shown in FIG. 7, wherein a plurality of hanger units 40, each having one or more dividers are toggled together by means of a generally keystone or key-shaped projection 42 interlocking in a complementary shaped recess 44 to form an assembly 46 of units 40 by slide fitting the units together in tongue and groove fashion. While a keystone shaped tongue and correspondingly shaped groove surface are shown here, it is within the scope of the invention to include all other interlocking shapes such as squares, rectangles, triangles and other polygonal shapes and cylinders. The assembly 46 can then be connected to a closet rod 48 with U-shaped brackets in the same manner as the hanger of FIGS. 1 and 2. The dividers and the pivoting flaps of this embodiment are constructed in the same manner as similar parts in the first embodiment and thus the same reference characters are used to identify like parts in both embodiments. It is to be understood that each unit can be constructed with more than or less than three dividers as shown to be toggled together to form an assembly of units without departing from the spirit of the invention.

Figure 8:
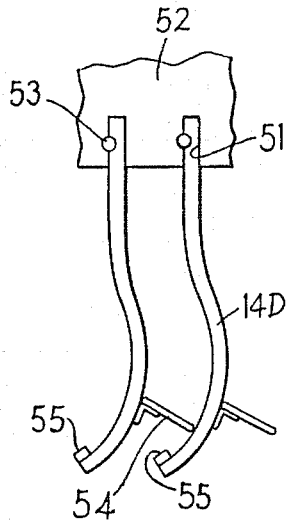
FIG. 8 is a side view of still another garment hanger according to the invention.

FIG. 8 illustrates yet another embodiment of the invention in which the divider members 14D are made of sheets of uniform thickness. The upper ends of the divider members 14D are slid laterally into slots 51 in the hanger unit 52 and are releasably locked in place by pins 53. The flaps 54 and the non-skid strip 55 cooperate with each other as described above.

Figure 9:
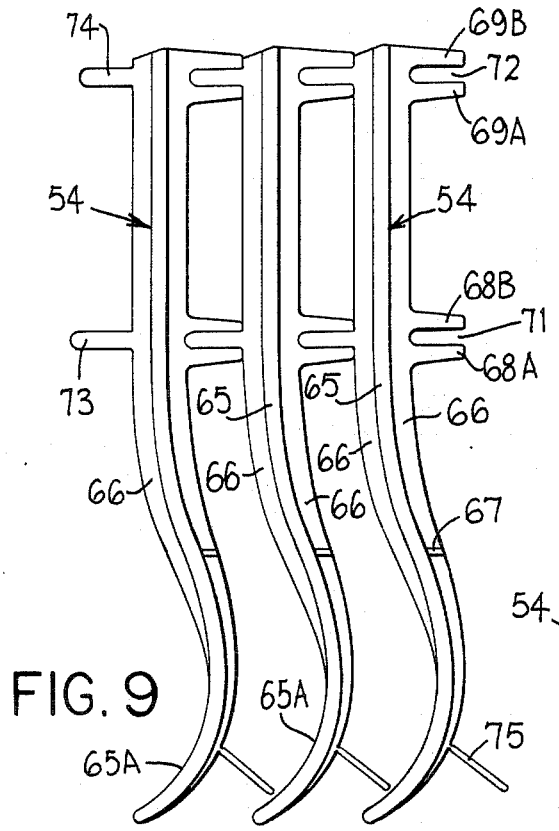
FIG. 9 is a view similar to FIG. 1 and showing yet another form hanger according to this invention.
Figure 10:
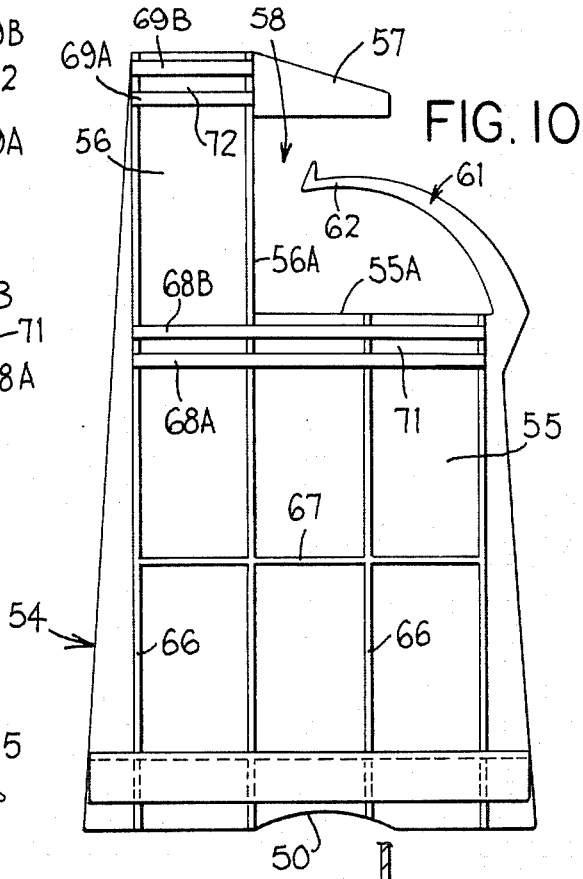
FIG. 10 is a side view of the garment hanger of FIG. 9.
Figure 11:
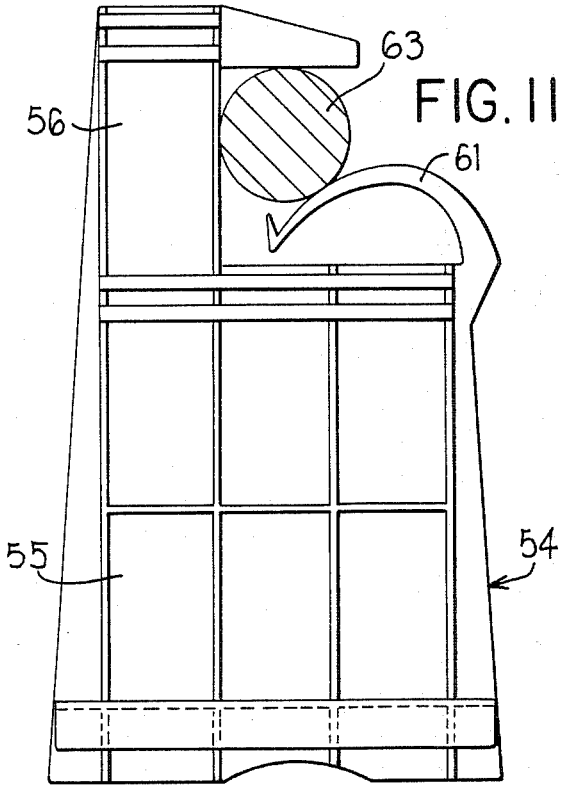
FIG. 11 is a view like FIG. 10 and showing the garment hanger installation on a closet rod.
Figure 12:
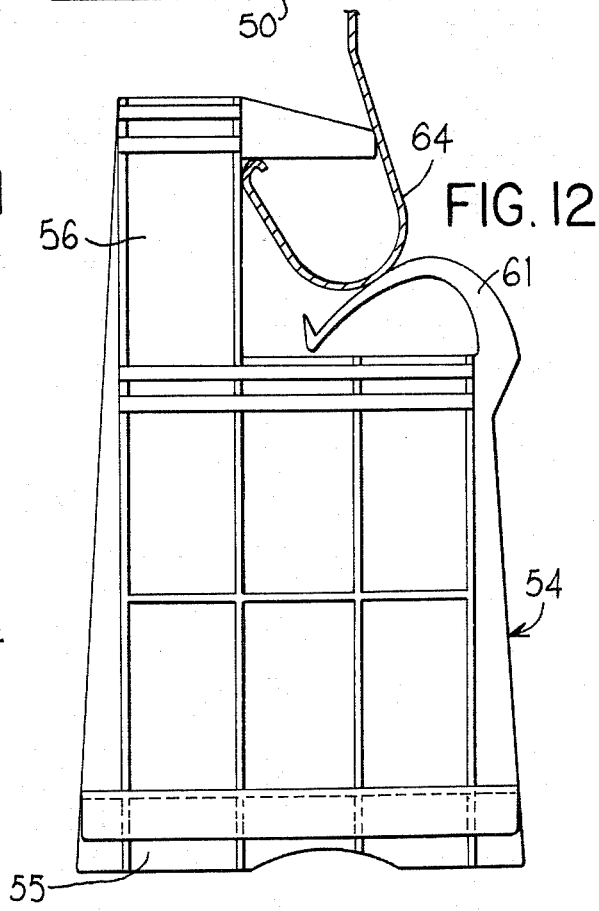
FIG. 12 is a view like FIG. 10 and showing the garment hanger installed on a substantially J-shaped support rail.

FIG. 9 illustrates a modification of the invention in which each of the upright divider members 54 is a one-piece member made by injection molding. Referring to FIGS. 10, 11 and 12, in plan view, each divider member 54 has a relatively wide lower base portion 55 and a relatively narrow upper support portion 56 extending upwardly from the upper side of the base portion 55 adjacent to the front side thereof (the leftward side in FIGS. 10, 11 and 12). The frontward and rearward edges of the divider members 54 flare at a small angle relative to each other in a downward direction so that the base portion 55 has a greater width at the bottom edge of the divider member for engaging articles of clothing. A bar 57 projects rearwardly from the upper end of the rearward edge 56A of the upper support portion 56 and extends substantially parallel with the upper edge 55A of the lower portion 55. The bar 57, the support portion 56 and the upper edge 55A of the lower portion 55 define a recess 58 which is open at the rearward side of the divider member 54 adjacent to the upper end thereof. An elongated, curved, elastically deformable, strip-like retainer 61 extends upwardly and forwardly from the rearward side of the upper edge 55A of the lower portion 55 of the divider member 54. The retainer 61 is curved so that it extends upwardly and forwardly through the open rearward side of the recess 58. The free end 62 of the retainer 61 extends generally parallel with the upper and lower sides of the recess 58 and is located approximately midway therebetween. The free end 62 of the retainer 61 can be resiliently deformed downwardly in order that a solid cylindrical closet rod 63 (FIG. 11) or a substantially J-shaped hanger 64 (FIG. 12) can be forced into the recess 58 from the open rearward side thereof. When the rod 63 or hanger 64 is disposed in the recess 58, it will be resiliently urged, by the resiliency of the retainer 61, upwardly and forwardly in said recess 58 against the upright rear edge 56A of the leg portion 56 and the lower edge of the bar 57, adjacent to the juncture thereof. The free end 62 of the retainer 61 can be resiliently deformed downwardly as needed to enable the closet rod 63 or the hanger 64 to be forced into and removed from the recess 58. For example, the divider members 54 can be mounted on the hanger 64 by revolving the divider members counterclockwise with respect to the rod or hanger from a starting position in which the divider members are located about 90 degrees clockwise from the positions thereof shown in FIGS. 11 and 12.

Each of the upright divider members 54 is comprised of a central web 65 having a plurality of integral, laterally spaced-apart, vertical ribs 66 projecting from the opposite surfaces thereof. The ribs 66 are omitted from the concave lower surfaces 65A of the divider members 54 (FIG. 9) so that the garments will be pressed against smooth, unribbed surfaces of the divider members 54. In the illustrated embodiment each of the upright divider members 54 also has a horizontal rib 67 projecting from the rear surface thereof. The horizontal rib 67 is not essential and it can be omitted.

Two pairs of parallel, horizontally extending flanges 68A, 68B and 69A, 69B, project rearwardly from the rearward surface of each divider member 54. The flanges 68A, 68B are located close to the upper edge 55A of the lower base portion 55 of the divider member and they extend across the full width of said lower base portion. The flanges 69A, 69B are located close to the upper edge of the support portion 56 and they extend across the full width of said support portion, but they do not extend across the bar 57. The pairs of flanges 68A, 68B and 69A, 69B, respectively, define horizontal, rearwardly opening grooves 71 and 72. Horizontal tongues 73 and 74 project forwardly from the frontward surface of each divider member 54 in alignment with the grooves 71 and 72, respectively. The tongues 71 and 72 of each divider member 54 are positioned so that they can be snugly and slidably received in the grooves 71 and 72, respectively, of the adjacent forward (leftward in FIG. 9) divider member 54 whereby the divider members can be releasably interlocked.

The convex lower surface of each divider member 54 has a pivotable flap 75, as in the previously described embodiments of the invention. The operation of this embodiment is like the operation of the previously described embodiments so that further explanation is believed to be unnecessary.

The various parts of the garment hanger of this invention can be constructed of any suitable material, including plastics which can be injection molded or manufactured by other suitable plastic forming processes.

The garment hanger according to the invention has a number of important advantages in comparison with the conventional garment hangers, including the following:

1. The operation of this garment hanger does not require any manual manipulation of parts of the hanger. Both hands of the user are free to hold the garment during insertion and removal. Insertion and removal of the garment is quick and convenient and it can be done without affecting other garments that are already being on #he unit.
2. The capacity of the unit is readily expandable by adding more dividers.
3. The structure is simple because no manually adjustable clamps, springs, etc. are employed. The unit can hold thick or thin garments readily and without structural modification because of the curvature of concave garment-supporting surface 28 and its relationship to the flap 30. The flap is always maintained in a position in which it is free to move downwardly by gravity to its lowermost garment-gripping position.
4. The garment hanger does not leave a crease or mark on the garment. The same garment hanger will hold pants or shirts.

Although the foregoing description has referred to use for hanging garments, and such is preferred, it will be evident that it can be used to support other thin flat objects, for example, auto floor mats. Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A garment hanger construction, comprising:

a pair of spaced-apart divider members having opposed substantially upright surfaces defining a downwardly opening garment-receiving space therebetween, at least one of said surfaces being concave in the vertical direction;

an elongated flap pivotally mounted at one end thereof on the other of said surfaces close to the lower end thereof, said flap extending across said garment-receiving space and toward said concave surface so that the opposite end of said flap is normally disposed close to said concave surface adjacent to the lower end thereof, said flap being pivotable upwardly in said garment-receiving space so that the spacing between said opposite end of said flap and said concave surface progressively increases in an upward direction as said flap is pivoted upwardly in said space.

2. A garment hanger as claimed in claim 1 in which each of said divider members is made of a one-piece synthetic resin molding.

3. A garment hanger as claimed in claim 1 in which each of said divider members has an upright central web defining said opposed substantially upright surfaces, and releasable interfitting means on said upright surfaces of said web for releasably interlocking said divider members with each other.

4. A garment hanger as claimed in claim 3 in which said interfitting means comprises at least one pair of flanges projecting from one of said upright surfaces and defining a groove, and a tongue projecting from the other of said surfaces so that the tongue of one of said divider members is releasably receivable in the groove of the adjacent divider member to releasably interlock said divider members.

5. A garment hanger as claimed in claim 3 comprising two vertically spaced-apart pairs of horizontal flanges projecting from one of said upright surfaces and defining two vertically spaced-apart grooves, one of said grooves being disposed close to the upper end of said garment hanger and the other of said grooves being disposed close of the upper end of said garment-receiving space, and two tongues projecting from the other of said surfaces and being disposed in horizontal alignment with said grooves, whereby the tongues on one of said divider members are releasably receivable in the grooves of the adjacent divider member to releasably interlock said divider members.

6. A garment hanger as claimed in claim 1 wherein said divider members each have an open-ended recess therein close to the upper end thereof for receiving a support therein, and retaining means for releasably retaining said support in said recess.

7. A garment hanger as claimed in claim 5 in which said divider member has a rearwardly opening recess therein between said pairs of grooves, said recess comprising horizontal upper and lower sides and an upright wall extending between the inner ends of said upper and lower sides, and an elongated, resiliently flexible, strip-like retainer extending from the outer end of said lower side partway toward the inner end of said upper side and adapted to resiliently retain a support in said recess.

8. A garment hanger as claimed in claim 3 in which each of said divider members has a plurality of vertical, laterally spaced-apart ribs projecting from the opposite surfaces of said web, said ribs being omitted from said concave surface so that the garments can be pressed against a smooth unribbed concave surface.

9. A garment hanger, comprising at least a pair of similarly shaped dividers disposed in fixed parallel spaced-apart relation to one another, said dividers having opposed upright surfaces defining a downwardly opening garment-receiving space therebetween, one of said surfaces being concave and the other of said surfaces being correspondingly convex and substantially parallel with said concave surface, a pivotable garment engaging flap extending between each pair of dividers, means for holding said dividers in said spaced-apart relation, each of said dividers having a said concave surface and a said convex surface on opposite sides thereof, said dividers being disposed so that said concave surfaces on all of said dividers face in the same direction and said convex surfaces on all of said dividers face in the opposite direction, each flap being pivotally mounted on the convex surface of its associated pair of dividers close to the lower end thereof and extending across the space between its associated pair of dividers toward the concave surface of its associated pair of dividers so that the opposite end of said flap is normally disposed close to said concave surface at a location close to the lower end thereof to engage and support a garment against the concave surface of its associated pair of dividers, said flap being pivotable upwardly in said garment-receiving space so that the spacing between said opposite end of said flap and said concave surface progressively increases in an upward direction as said flap is pivoted upwardly in said space.

* * * * *